United States Patent [19]

Pugh

[11] 4,151,917

[45] May 1, 1979

[54] SHELF SYSTEM

[75] Inventor: Bernard J. Pugh, Hayward, Calif.

[73] Assignee: TAP Plastics, Inc., San Leandro, Calif.

[21] Appl. No.: 805,122

[22] Filed: Jun. 9, 1977

[51] Int. Cl.[2] ..... A47F 3/14

[52] U.S. Cl. ..... 211/126; 211/182; 211/187; 248/243

[58] Field of Search ..... 211/187, 186, 126, 208, 211/182, 134, 190, 193; 108/108; 248/243

[56] References Cited

U.S. PATENT DOCUMENTS

| | | | |
|---|---|---|---|
| 443,866 | 12/1890 | Pauli | 108/108 |
| 3,229,823 | 1/1966 | Hummer | 211/187 |
| 3,631,821 | 1/1972 | Zachariou | 211/187 X |
| 3,647,078 | 3/1972 | Fortunato | 211/134 |
| 3,949,880 | 4/1976 | Fortunato | 211/126 X |
| 4,018,019 | 4/1977 | Raith et al. | 248/243 X |
| 4,040,588 | 8/1977 | Papsco et al. | 108/108 X |

FOREIGN PATENT DOCUMENTS

| | | | |
|---|---|---|---|
| 1236722 | 6/1960 | France | 211/134 |
| 524533 | 4/1955 | Italy | 211/134 |

*Primary Examiner*—Roy D. Frazier
*Assistant Examiner*—Robert W. Gibson, Jr.
*Attorney, Agent, or Firm*—Harris Zimmerman

[57] ABSTRACT

A shelf system for enhancing the display of objects supported on the shelves thereof includes at least a pair of vertical runners secured to a wall member. A shelf bracket is secured to detent holes in each of the vertical runners, and includes a portion extending parallel to the wall. The shelf member includes at least a pair of planar support members extending therefrom. Each support member is provided with a right trapezoidal configuration, with a slot disposed in the orthogonal non-parallel side of the member. The slot receives the support bracket therein for support of the shelf, which is secured to the obliquely extending non-parallel side of the support member.

4 Claims, 4 Drawing Figures

SHELF SYSTEM

BACKGROUND OF THE INVENTION

It is well-known in the prior art to construct shelf systems by means of vertical runners secured to wall members or the like. These vertical runners generally include a plurality of detent holes spaced longitudinally thereon. The system includes a plurality of shelf brackets each having teeth for engaging at least one of the detent holes of the vertical runners in a supporting fashion.

Generally speaking, these prior art shelf brackets extend orthogonally from the vertically disposed runners, and the shelves of the systems rest atop the generally horizontal shelf brackets. Thus the shelves themselves are disposed in a horizontal plane.

In many situations, such as commercial display of items for sale, it would be advantageous to have the shelves angled obliquely upwardly so that the items supported thereon would more directly meet the gaze of the viewer or prospective buyer. There is no system known in the prior art for this type of display.

SUMMARY OF THE PRESENT INVENTION

The present invention generally comprises a shelf system which provides a plurality of shelves angled obliquely upwardly to enhance the display effect of the items supported thereon, and to present them more directly to the gaze of the viewer. It includes at least a pair of vertical runners secured to a wall or similar supporting structure. Each of the runners includes a plurality of detent holes spaced longitudinally therein.

The shelf brackets of the present invention each include a pair of orthogonally related web portions joined together at a common edge, and both extending in a vertical plane. One edge of one of the web members is provided with teeth for engaging at least one of the detent holes of the vertical runner in a supporting fashion. The other web member extends in a vertical plane parallel to the wall which supports the shelf system. The shelf members themselves are formed in the fashion of a tray, including a laterally extending bottom panel which is canted obliquely upwardly, a laterally extending back panel joined to the rear edge of the bottom panel in orthogonal relationship thereto, and a pair of side members extending between the distal end portions of the bottom panel and back panel. A low front panel may also be provided, joined to the front edge of the bottom panel.

The shelf members are removably secured to the brackets by means of unique support members. The generally planar support members are provided with a right trapezoidal configuration, with the oblique non-parallel edge thereof secured to the rear surface of the back panel. Extending into the orthogonal non-parallel side is a generally upwardly extending slot which receives the web portion of the shelf bracket therein in a supporting relationship. The orthogonal non-parallel edge of the support member rests against the wall to provide longitudinal as well as vertical support of the shelf member, and the angular relationship of the oblique non-parallel side cants the shelf member angularly upwardly to provide more effective display of the items supported thereon.

The slots of the shelf support member provides quick and easy engagement and disengagement with the web portion of the shelf brackets. Thus the shelves may be moved and rearranged easily, yet are securely supported when assembled to the shelf brackets.

A BRIEF DESCRIPTION OF THE DRAWING

DESCRIPTION OF THE PREFERRED EMBODIMENT

Figure 1:
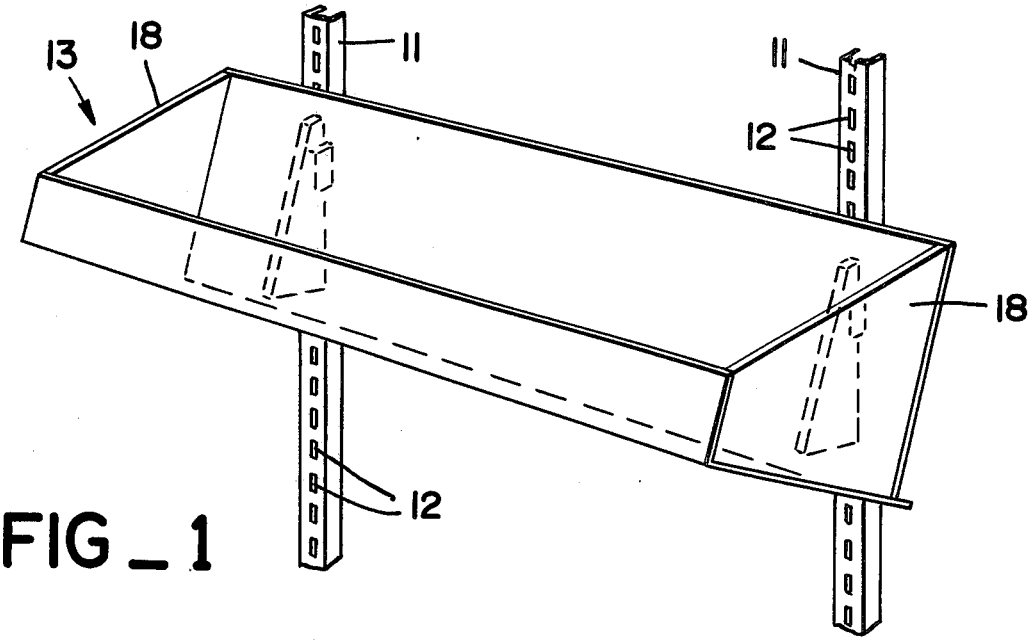
FIG. 1 is a perspective view of the shelf system of the present invention.

As shown in FIG. 1, the shelf system of the present invention generally comprises at least a pair of vertically disposed runners 11. These runners may be secured to a wall or similar structural member. Each of the vertical runners is provided with a plurality of oblong detent holes 12 spaced longitudinally therein. This form of vertical support runner is well known in the art, and need not be described in greater detail herein.

Figure 2:
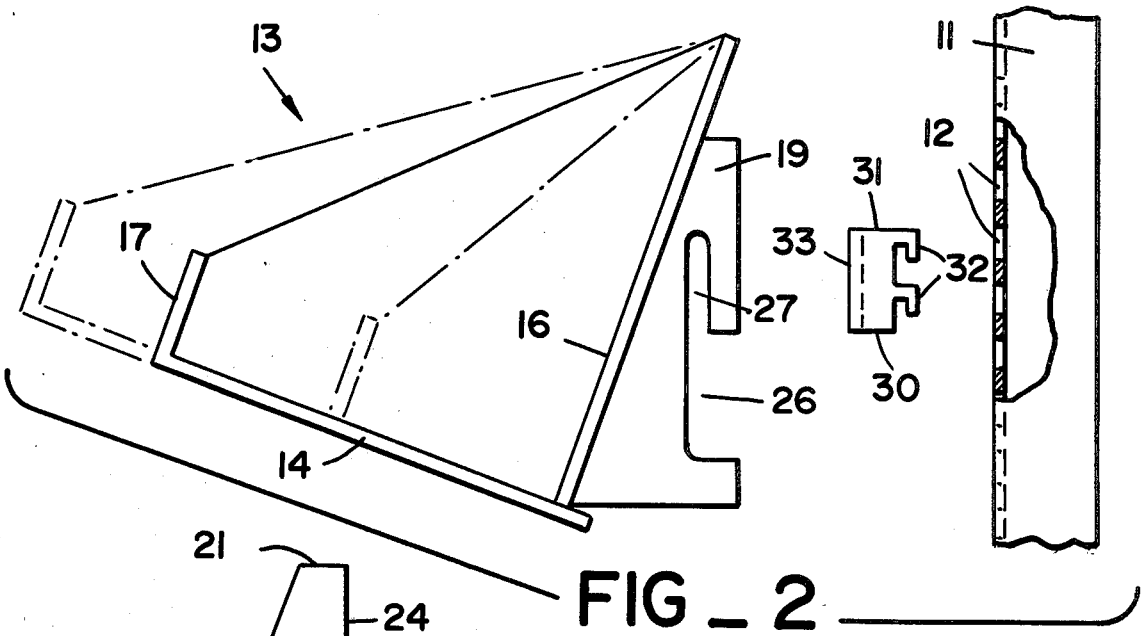
FIG. 2 is an exploded side view of the components of the shelf system of the present invention.
Figure 3:
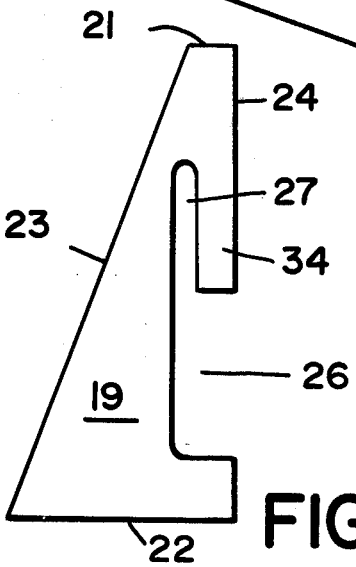
FIG. 3 is a side elevation of the support member of the shelf system of the present invention.

The present invention also includes a plurality of shelf members 13. As shown in FIG. 2, each of the shelf members includes a laterally extending bottom panel 14 which is canted obliquely upwardly. A back panel 16 extends orthogonally from the member 14 and is joined to the rear edge portion thereof. A laterally extending front panel 17 is secured to the front edge of the member 14, and is generally perpendicular thereto.

As shown in FIG. 1, each of the shelf members 13 is provided with a pair of end plates 18. The end plates are planar members having a generally trapezoidal configuration, with the three orthogonally related sides thereof joined to the bottom, rear, and front panels of the shelf member at the distal end portions thereof. The end plates 18 join the bottom rear and front panels in a rigid structure which is capable of supporting the weight of display items.

The shelf member 13 of the present invention also includes at least a pair of support members 19, the number of support members being equal to the number of vertical runners 11. Each of the support members 19 comprises a generally planar member having a right trapezoidal configuration. The oblique side 23 of the support member 19 is joined to the rear surface of the rear panel 16 of the shelf member by adhesive means, welding, or the like. The support member 19 includes two parallel sides 21 and 22, the shorter of the parallel sides being disposed at the upper end of the member. The orthogonal non-parallel side is disposed to impinge on the face of the vertical runner 11.

Extending perpendicularly into the edge 24 of the support member 19 is a generally rectangular recess 26. A slot 27 extends upwardly from the recess 26, parallel to the edge 24, with one edge of the slot 27 extending continuously with the inner edge of the recess 26. The recess 26 is disposed in a lower medial portion of the vertical extent of the edge 24, with the slot 27 extending to an upper medial portion of the member 19.

Figure 4:
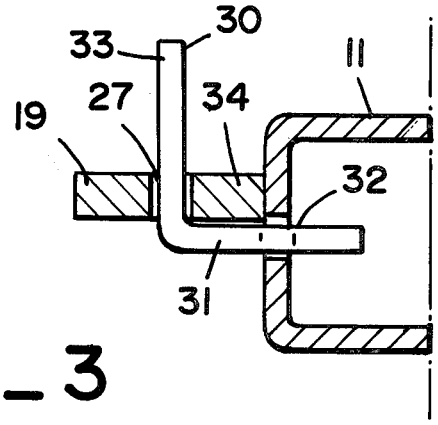
FIG. 4 is a cross-sectional view showing the assembly of the support member, shelf bracket, and vertical runner of the shelf system of the present invention.

The present invention also includes at least a pair of shelf brackets 30, each one joining a support member 19 to one of the vertical runners 11 in supporting relationship. Each of the brackets 30 includes a pair of vertically extending web members 31 and 33 joined in orthogonal relationship along a common vertical edge. The distal vertical edge of the web portion 31 is provided with a pair of downwardly extending teeth 32 which are adapted to engage to consecutive detent holes 12 in the vertical runner 11. As shown in FIG. 4, the web portion 31 extends perpendicularly outwardly from the face of the vertical runner 11, and the web portion 33 extends generally parallel to the wall surface to which the vertical runner 11 is secured.

The web portion 33 is adapted to engage the slot 27 in the support member 19, to provide vertical support for the shelf member 13. The recess 26 provides access to the slot 27 for the web portion 33, and the weight of the shelf member maintains the engagement of the shelf bracket 30 and the support member 19. It should be noted that the portion of the support member 19 lying between the inner edge of the recess and slot and the outer edge 24, is equal in width to the spacing of the web portion 33 and the outer face of the vertical runner 11. This spacing, together with the weight of the shelf member 13, provides vertical stability for the shelf member.

With reference to FIGS. 1 and 2, it may be appreciated that the upward angular canting of the shelf member 13 is due to the angular relationship of the sides 23 and 24 of the support members 19, and that the angle of the shelf member 13 is determined by the angle of the side 23. In this regard, it should be noted that the upper side 21 of the support member 19 acts as a spacer to prevent the upper edge of the rear panel 16 from impinging on the vertical runner 11. If the angle of the side 23 with respect to the side 24 is increased, the dimension of the side 21 must also be increased to provide sufficient clearance for the upper edge of the rear panel 16.

In the preferred embodiment of the present invention, the support members 19, as well as the panel members that form the shelf member 13, are all formed of a transparent, generally rigid plastic material such as acrylic panels or the like. The shelf system thus formed provides a striking display of the items supported thereon, and presents them directly to the line of sight of the viewer.

It may be appreciated that the shelf system of the present invention is easily assembled to form a rigid, secure structure. Also, the slip fit of the web portion 33 of the bracket 30 permits the system to be dismantled and rearranged with great ease, so that the shelf system is easily adaptable to the display of items of various sizes and configurations.

I claim:

1. A shelf system comprising at least one vertically extending runner having a plurality of detent holes spaced longitudinally therein, a laterally extending shelf member, and means for securing said shelf member to said runner in upwardly canted, supported relationship; said means including at least one bracket having means for engaging at least one of said detent holes, and at least one support member, said support member including a vertically extending slot for engaging a portion of said bracket, said support member including a pair of opposed, non-orthogonally related sides, one of said sides secured to said shelf member and the other impinging on said vertical runner, and said support member comprising a generally planar member having a right trapezoidal configuration with the non-orthogonal side thereof secured to said shelf member.

2. The shelf system of claim 1, wherein said support member includes a generally rectangular recess disposed in the orthogonal non-parallel side thereof.

3. The shelf system of claim 2, wherein said vertically extending slot opens to the upper inner portion of said recess.

4. A shelf system comprising at least one vertically extending runner having a plurality of detent holes spaced longitudinally therein, a laterally extending shelf member, and means for securing said shelf member to said runner in upwardly canted, supported relationship; said means including at least one bracket having means for engaging at least one of said detent holes, and at least one support member, said support member including a vertically extending slot for engaging a portion of said bracket, said support member including a pair of opposed, non-orthogonally related sides, one of said sides secured to said shelf member and the other impinging on said vertical runner, and said bracket comprising a pair of vertically extending web portions joined in orthogonal relationship along a common vertical edge, one of said web portions including said means for engaging at least one of said detent holes and the other web portion engaging said vertically extending slot.

* * * * *